US006173937B1

(12) United States Patent
Cottongim

(10) Patent No.: US 6,173,937 B1
(45) Date of Patent: Jan. 16, 2001

(54) CAP CLIP AND SPREADER FOR POURED CONCRETE WALL FORMS

(75) Inventor: Norman Cottongim, Richwood Hill, GA (US)

(73) Assignee: Feather Lite Innovations, Inc., Springboro, OH (US)

( * ) Notice: Under 35 U.S.C. 154(b), the term of this patent shall be extended for 0 days.

(21) Appl. No.: 09/232,146

(22) Filed: Jan. 15, 1999

Related U.S. Application Data

(60) Provisional application No. 60/071,743, filed on Jan. 16, 1998.

(51) Int. Cl.[7] ..... E04G 11/06

(52) U.S. Cl. ..... 249/40; 249/45; 249/190; 249/192; 249/216; 249/47; 249/4; 52/584.1; 52/426; 52/742.14; 52/745.1; 52/745.13

(58) Field of Search ..... 249/40, 44, 45, 249/190, 191, 192, 216, 47, 2, 5, 4, 34; 52/742.14, 745.1, 745.13, 584.1, 426; 403/292, 293, 286, 287, 336, 338; 24/546, 570, 459

(56) References Cited

U.S. PATENT DOCUMENTS

| | | | | |
|---|---|---|---|---|
| D. 317,250 | | 6/1991 | Shook et al. . | |
| 1,224,810 | | 5/1917 | Tenholder . | |
| 1,367,438 | | 2/1921 | Strausbaugh . | |
| 1,607,114 | * | 11/1926 | Byrd | 249/216 |
| 1,739,254 | * | 12/1929 | Mosel | 249/47 |
| 3,381,929 | | 5/1968 | Bancker . | |
| 3,614,051 | | 10/1971 | Trimmer . | |
| 3,797,800 | | 3/1974 | Loy . | |
| 4,062,514 | | 12/1977 | Scott-King . | |
| 4,889,310 | | 12/1989 | Boeshart . | |
| 5,098,059 | | 3/1992 | Sawyer . | |
| 5,119,567 | | 6/1992 | Fox . | |
| 5,191,718 | | 3/1993 | Fox . | |
| 5,511,353 | * | 4/1996 | Jones | 52/536 |
| 5,799,399 | * | 9/1998 | Schultz | 29/897.3 |

* cited by examiner

*Primary Examiner*—Richard Chilcot
*Assistant Examiner*—Dennis L. Dorsey
(74) *Attorney, Agent, or Firm*—Wood, Herron & Evans, L.L.P.

(57) ABSTRACT

Standard height wall form panels for poured concrete walls are extended with cap panels positioned on top thereof and secured thereto with cap clips which can be conveniently and easily installed and disassembled with the wall form panels. Furthermore, a spreader is used to maintain the spacing of the cap panels and provide a uniformly dimensioned concrete wall. Advantageously, the spreader in one embodiment allows a worker to pass a trowel there beneath to smooth out the top surface of the poured concrete wall.

23 Claims, 3 Drawing Sheets

CAP CLIP AND SPREADER FOR POURED CONCRETE WALL FORMS

This claims the benefit of U.S. Provisional Patent Application Ser. No. 60/071,743, filed Jan. 16, 1998 and hereby incorporated by reference in its entirety.

BACKGROUND OF THE INVENTION

This invention relates to poured concrete wall forms, and more particularly, to hardware for connecting and positioning the various opponents of poured concrete wall forms.

It is well known in the art to use prefabricated reusable panel units to construct a wall form for a poured concrete wall. Typically, a pair of spaced generally parallel wall forms are constructed from a plurality of individual panels. The individual panels are connected together with various attachment hardware to construct the wall form. After the spaced wall forms are constructed, concrete is poured between the wall forms and allowed to cure or harden at which time the wall forms, panels and associated hardware are disassembled, collected and transported to another site for reuse. Typically, a panel used in constructing a wall form is approximately 8' high and 2' to 3' in width. The individual panels each include a marginal frame projecting rearwardly from a back face of the panel to include a flange along the spaced side edges and top and bottom edges of the panel. The side flanges are adapted to be positioned in a face-to-face relationship with the flange of an adjacent panel for connection therewith to construct a concrete wall form. Holes in the side flanges of the adjacent panels can be aligned to receive therethrough the shank of a pin or a bolt. The bolt or pin may pass through the ends of tie rods and are held in position commonly by wedges which project through a slot in the shank of the bolt or pin. The tie rods serve an important function by maintaining the spaced wall forms at a predetermined distance so that the resulting poured concrete wall is of a uniform thickness, shape and configuration.

Due to the wide variety of architectural plans and construction designs, individual wall form panels of various sizes are frequently used in combinations to construct an appropriately configured wall form. Typically, panels having a width of 12" or less are called fillers and are often used with other "standard" size panels to construct a wall form.

Commonly, poured concrete walls are used to construct the foundation or basement of a residential house or other building. Typically, 8' high panels have been used to construct the wall forms for such a basement or foundation. However, frequently a filler panel of typically 12" in width is laid on its side atop the top edge of the wall form panels as a cap panel to provide a 9' high wall form. The extended height wall form and resulting poured concrete wall are commonly required for an elevated ceiling in the basement or extra head room to conceal duct work, wiring, plumbing or the like without diminishing the 8' high ceiling in the basement or foundation.

In the construction of a concrete wall form, a large quantity of hardware is necessary to connect the adjacent panels together. This situation is further complicated when a filler panel is positioned atop a standard 8' wall form to provide an 9' high wall. Furthermore, the wall forms are commonly constructed in excavated areas such as ditches and trenches with basement or below ground floor of a commercial building. As such, the work space for constructing the wall form and for the workers to maneuver and manipulate the associated hardware and panels is extremely tight and limited.

Therefore, the installation of the attachment hardware for the various panel configurations must be convenient, easily performed and require a minimal amount time and effort. The cost of labor and materials, therefore, has a significant impact upon the effectiveness of the wall form panel and attachment hardware designs.

The attachment hardware commonly used to secure adjacent panels in a side-by-side relationship cannot be used for securing an upper cap panel or filler panel atop the standard 8' high panels because of the orientation and configuration of the holes, pins and the like. Nevertheless, off-the-shelf products are often used in an attempt to secure the upper cap panel, and these techniques and attachment schemes often prove to have limited success. As a result, the upper cap panel may waiver or become misaligned with respect to the lower panels or with respect to the opposing wall form. Commonly, a 2'×4' or other member spanning the wall forms is clamped or secured to the upper flange of the cap member with a C-clamp or the like and the lower flange of the cap member and the upper flange of the panel are likewise clamped or otherwise secured together. However, this often proves to be a very time consuming and problematic operation for the workers.

Therefore, there exists a need in the industry for an attachment mechanism for coupling an upper cap panel onto a wall form and accurately and securely maintaining the cap panel in position relative to the opposite wall form, all of which is easily and conveniently installed and disassembled by the workers in the field.

SUMMARY OF THE INVENTION

These and other objectives of the invention have been attained by a novel cap clip and a novel spreader for coupling a cap panel to a lower panel and maintaining the cap panel in position relative to the opposing wall form to construct a poured concrete wall. In a presently preferred embodiment of the invention, the cap clip can be conveniently used to connect the bottom flange of a cap panel to the top flange of a wall form panel. The cap clip has a generally I-beam shaped configuration with a lower generally planar flange connected to an upper flange via a central web. The upper flange has a pair of clip arms, one of which depends downwardly from each of the spaced outer edges of the upper flange. The cap clip can be conveniently installed onto the top flange of a wall form panel. Preferably a plurality of cap clips are used at a spacing of approximately 3' or so for secure attachment of the cap panel to the wall form. The bottom flange of the cap panel is rotated into a receiving pocket of the cap clip formed between the upper and lower flanges. As a result, the upper cap panel is easily, conveniently and securely attached to the upper flange of a wall form.

Additionally, a spreader is conveniently used to maintain the spacing of the upper cap panels between the opposing wall forms. In a presently preferred embodiment, the spreader includes a central spreader section which spans the distance between the spaced wall forms. The spreader section includes a pair of spaced downwardly depending spreader tabs which are conveniently positioned along the inner planar front face of the upper cap panels of the spaced wall forms. Clip arms extend from the ends of the spreader section to conveniently couple to the upper flange of the cap panels. The rigid configuration of the spreader with a predefined spacing between the spreader tabs and associated clip arms maintains the cap panels in a specified spaced relationship while the concrete is poured therebetween and allowed to cure or harden.

In a second presently preferred embodiment, the spreader section is elevated relative to the top flanges of the spaced cap panels to provide access for a worker to smooth out the top edge of the poured concrete wall with a trowel or other appropriate tool.

BRIEF DESCRIPTION OF THE DRAWINGS

The objectives and features of the invention will become more readily apparent from the following detawhich.

DETAILED DESCRIPTION OF THE INVENTION

Figure 1:
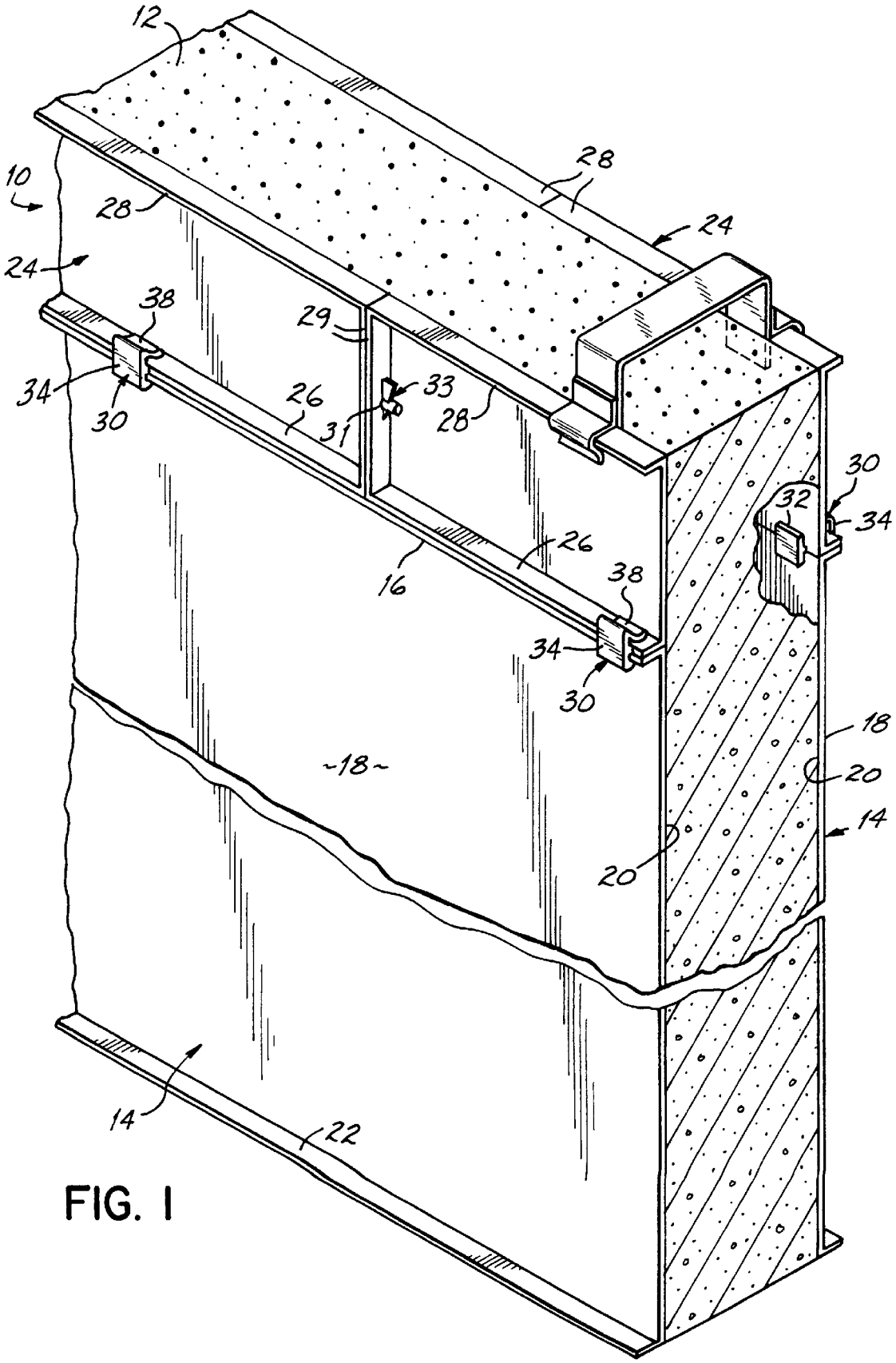
FIG. 1 is a perspective view of a pair of spaced wall form panels, each of which have a cap panel secured thereto by a plurality of cap clips according to a presently preferred embodiment of this invention and the cap panels are maintained at a pre-determined spacing by a spreader according to one presently preferred embodiment of this invention.

Referring to FIG. 1, a presently preferred embodiment of a pair of spaced wall forms 10 for constructing a poured concrete wall 12 therebetween is shown. Each wall form includes a standard panel 14 which is customarily 840 in height and has an upper flange 16 projecting rearwardly from a back face 18 of the panel 14 and a generally planar front face 20 confronting and spaced from the 20 opposing wall form 10. The wall panel 14 also includes a bottom flange 22 spaced from the top flange 16 and a pair of spaced side flanges (not shown). As is well known, the side flanges are used for adjoining the wall panel along the side edge to an adjacent similarly configured wall panel. The present invention is useful with a wide variety of known wall panel designs and a presently preferred embodiment of a wall panel is disclosed in U.S. Provisional Patent Application Ser. No. 60/071,758, filed Jan. 16, 1998, assigned to the assignee of this invention and hereby incorporated by reference in its entirety.

Figure 2:
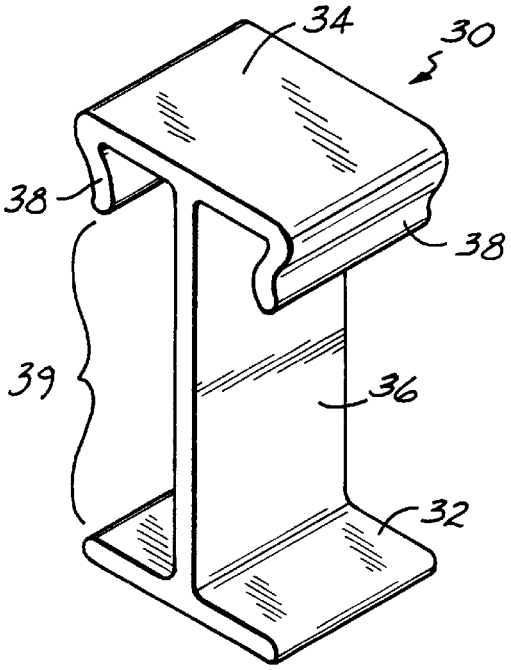
FIG. 2 is a perspective view of the cap clip according to this invention.
Figure 3:
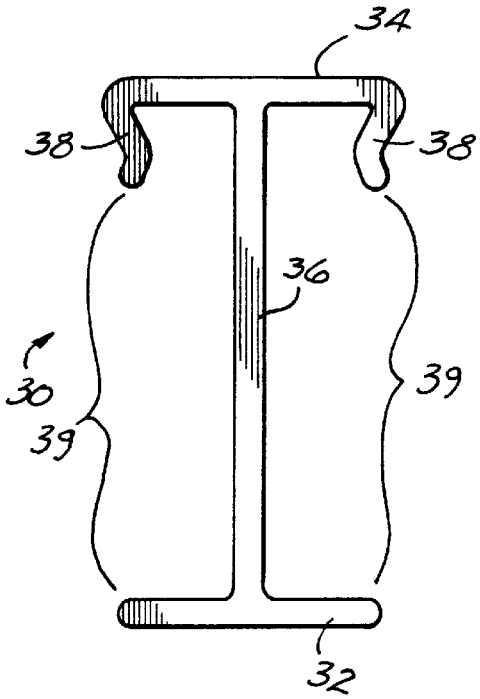
FIG. 3 is an end view of the cap clip of FIG. 2.

Commonly, as shown in FIG. 1, a cap panel 24, which may be constructed according to U.S. Provisional Patent Application Ser. No. 60/071,758, is added to the top of the standard wall panel 14 to form an extended height wall form 10. Conventionally, the cap panel 24 is 12" in width and extends from the wall form 10 to a height of 9' to construct an 9' high poured concrete wall 12. The cap panel 24 includes a longitudinal bottom flange 26 and a longitudinal top flange 28 as well as marginal side flanges 29. The marginal side flange 29 of the cap panel 24 may include a hole 31 for connecting the cap panel 24 to an adjacent cap panel 24 with a pin and wedge assembly 33. Advantageously, according to a presently preferred embodiment of this invention, a plurality of cap clips 30, as shown in FIGS. 1–3, are used to attach the cap panel 24 to the top flange 16 of the wall form panels 14. The cap clip 30 according to a presently preferred embodiment of this invention has a generally I-beam shaped configuration with a planar bottom flange 32 connected to an upper flange 34 by a web 36. The upper flange 34 has spaced side edges, each of which have a downwardly depending clip arm 38. Each portion of the bottom flange 32, in cooperation with a side face of the web 36 and the corresponding portion of the top flange 34 and associated clip arm 38, form a pocket 39 for receiving the top flange 16 of the panel 14 or the bottom flange 26 of the cap panel 24. Preferably, the cap clip 30 is extruded from 6061T-6 aluminum.

Installation of the cap clip 30 and assembly of the cap panel 24 to the standard panels 14 is as follows. Once the standard wall form panels 14 are assembled in the side-by-side relationship as is well known by one of ordinary skill in the art, the cap clip 30 is attached to the top flange 16. With the cap clip 30 in a generally horizontal attitude with the central web 36 generally horizontal, the bottom clip arm 38 of the cap clip 30 is snapped onto the rearwardly extending edge of the top flange 16 while the clip 30 is then rotated so that the web 36 is generally parallel to and in face-to-face juxtaposition with the top face of the top flange 16 of the panel 14. A downwardly depending portion of the bottom flange 32 of the cap clip 30 is then juxtaposed in face-to-face relationship with the generally planar front face 20 of the panel 14, as shown in FIG. 1. Preferably, a plurality of cap clips 30 are installed in this matter on the top flange 16 of the panel 14 and are spaced generally 3' apart.

The cap panel 24 is then attached by inserting the rearward most edge of the bottom flange 26 of the cap panel 24 into the exposed pocket 39 of each of the clips 30 in position on the top flange 16 of the panel 14. The leading edge of the bottom flange 26 of the cap panel 24 is then rotated and slid along the web 36 until it is seated within the exposed pocket 39 of the cap clip 30 and mates with the clip arm 38. The trailing edge of the bottom flange 26 of the cap panel 24 is then seated in the pocket 39 in conforming relationship at the juncture between the web 36 and the remaining portion of the bottom flange 32 of the cap clip 30 thereby securing the cap panel 24 to the wall form panels 14 with the cap clips 30. The procedure is repeated with the opposing wall form 10 thereby securing the cap panels 24 and extending the height of the standard wall form configuration.

Figure 4:
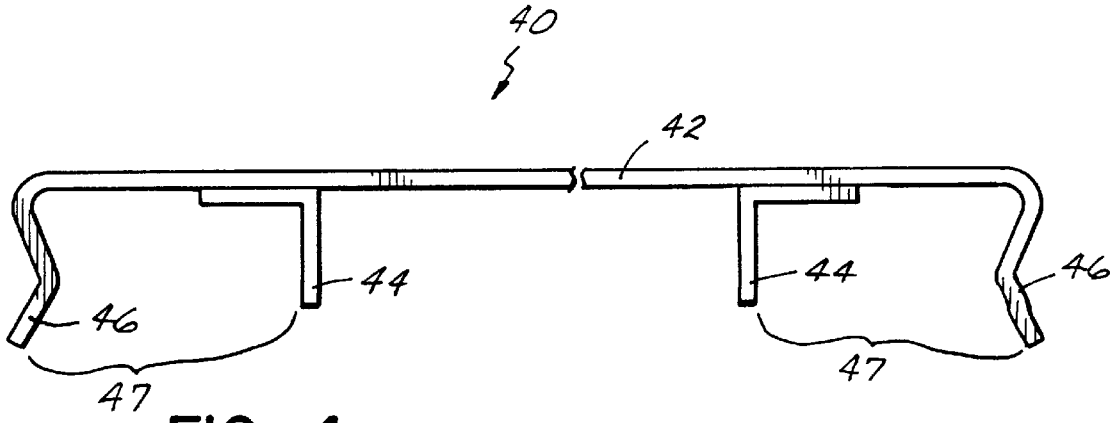
FIG. 4 is an alternative embodiment of a spreader according to this invention.
Figure 5:
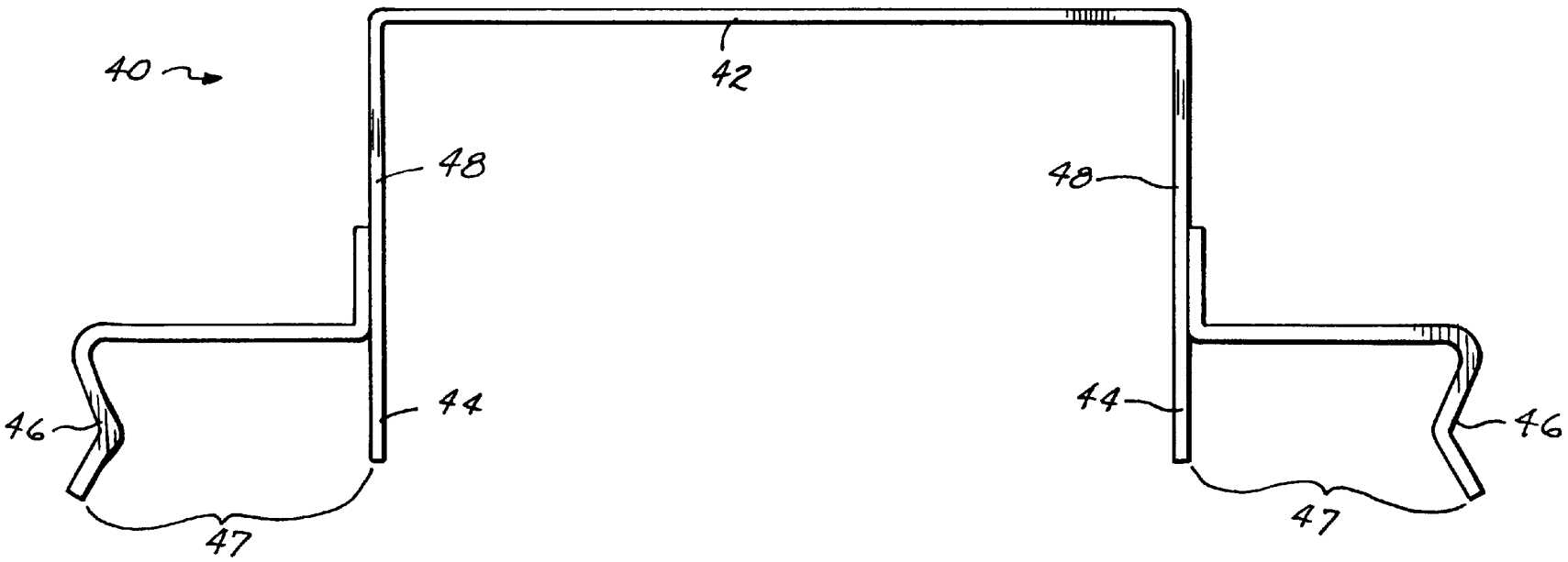
FIG. 5 is a view of the spreader of FIG. 1.

Referring to FIG. 4, a presently preferred embodiment of a spreader 40 according to this invention is shown. The spreader 40 includes a central spreader section 42 having a pair of generally L-shaped members projecting downwardly from the bottom surface of the spreader section 42. Each L-shaped member includes a downwardly depending spreader tab 44 which projects perpendicular to the spreader section 42. Preferably, the spreader tabs 44 are spaced approximately 7½" apart. A clip arm 46 is provided on each end of the spreader section 42 and is spaced from the spreader tab 44 to form a flange receiving pocket 47 on each end of the spreader 40. An alternative embodiment of the spreader 40 according to this invention is shown in FIGS. 1 and 5 and includes a pair of risers 48 which elevate the central spreader section 42 relative to the clip arms 46 and the spreader tabs 44. Preferably, the spreader 40 is 10 gauge HRS steel with the clip arms 46 or spreader tabs 44 welded in place.

In use, the spreader 40 according to the embodiment shown in FIGS. 1 or 4 is installed onto the spaced wall forms 10 to maintain the spaced cap panels 24 a specified distance apart, typically 7½'. After the cap panels 24 are secured to the wall form panels 14 with the cap clips 30, the spreaders 40 are snapped downwardly onto the top flanges 28 of the spaced cap panels 24. The clip arms 46 will deflect outwardly around the top flanges 28 so that the top flange 28 is then received in the pocket 47 of the spreaders 40. The spreader tabs 44 are positioned in face-to-face relationship with the front face of the cap panel 24. The spreader tabs 44, in combination with the clip arms 46, solidify the top flanges 28 of the cap panel 24 in position relative to one another for pouring of the concrete between the wall forms 10.

Advantageously, the spreader 40 of FIGS. 1 and 5 enables a worker to pass a trowel beneath the central spreader section 42 to smooth out the top surface of the poured concrete wall prior to curing.

From the above disclosure of the general principles of the present invention and the preceding detailed description of a preferred embodiment, those skilled in the art will readily comprehend the various modifications to which this invention is susceptible. Therefore, I desire to be limited only by the scope of the following claims and equivalents thereof.

I claim:

1. A pair of spaced wall forms for constructing a poured concrete wall therebetween, each of the wall forms comprising:

a plurality of wall panels each having a generally planar front face and a rearwardly extending top panel flange along a top edge of the wall panel;

a plurality of cap panels mounted atop the wall panels, each cap panel having a top cap flange and a bottom cap flange projecting rearwardly from a generally planar front face of the cap panel along top and bottom edges thereof, respectively; and a plurality of cap clips securing the cap panel to the respective wall panels, each cap clip capturing the top wall flange of the wall panels and the bottom cap flange of the cap panel to thereby secure the cap panel to the wall panel with the front faces of the cap panel and wall panels being generally co-planar;

wherein the cap clips each further comprise a pair of flange receiving pockets formed between a central web, a clip flange and clip arms.

2. The wall forms of claim 1 wherein the cap clips each have a generally I-beam shaped configuration.

3. The wall forms of claim 1 wherein the clip flange is juxtaposed to the inner faces of the wall panels and the cap panel.

4. The wall forms of claim 1 wherein the pair of flange receiving pockets of each cap clip includes first and second pockets with the first pocket being secured around the top wall flange of the wall panels and the second pocket being secured around the bottom cap flange of the cap panel with the web of the clip being juxtaposed between the top wall flange and the bottom cap flange.

5. The wall forms of claim 1 further comprising:

a spreader mounted to the top cap flange of each of the cap panels and spanning the gap between the spaced wall forms.

6. The wall forms of claim 5 wherein the spreader includes a central spreader section having spaced ends with flange receiving pockets on the spaced ends of the spreader, each of the flange receiving pockets being coupled to the top cap flange of one of the cap panels.

7. The wall forms of claim 6 wherein the spreader section is elevated relative to the top flanges of the cap panels by a pair of risers projecting from the ends of the spreader section to provide clearance between the spreader section and the top of the poured concrete wall.

8. The wall forms of claim 6 wherein the spreader further comprises a pair of downwardly depending spreader tabs each of which is positioned on the front face of one of the cap panels to maintain a pre-determined spacing between the cap panels of the spaced wall forms.

9. A combination comprising:

a pair of spaced wall forms for constructing a poured concrete wall therebetween, each of the wall forms being constructed of a plurality of wall panels each having a generally planar front face and rearwardly extending top flanges, each wall form further including a cap panel mounted atop the wall panels, each cap panel having a top flange and a bottom flange projecting rearwardly from a generally planar front face of the cap panel along top and bottom edges thereof, respectively;

a plurality of cap clips securing the cap panel to the respective wall panels, each cap clip having a generally I-beam shaped configuration with a generally planar flange being joined to a clip flange via a connecting web, the clip flange having a pair of spaced clip arms depending from a generally planar portion of the clip flange, each clip arm cooperating with a corresponding portion of the planar flange and the web to form a flange-receiving pocket, each clip having first and second pockets with the first pocket being secured around the top flange of the wall panels and the second pocket being secured around the bottom flange of the cap panel with the planar flange of the clip being juxtaposed to the front faces of the standard wall and cap panels; and a spreader mounted to the top flange of each of the cap panels and spanning the gap between the spaced wall forms, the spreader including a central spreader section having spaced ends, the spreader further including a pair of downwardly depending spreader tabs each of which is positioned on the front face of one of the cap panels to maintain a pre-determined spacing between the cap panels of the spaced wall forms, the spreader also having a pair of flange-receiving pockets each of which are clipped to the top flanges of one of the cap panels, the pockets being formed from the spreader tabs and a pair of clip arms to engage the cap panel top flanges.

10. A connector for connecting adjacent wall form panels used in constructing a poured concrete wall, each of the wall form panels having a rearwardly extending flange proximate an edge of the panel, the connector comprising:

a clip having a pair of flange receiving pockets each of which captures the flange of one of the wall form panels with a central web of the clip being adapted for juxtaposition between the flanges of the adjacent wall form panels with the front faces of the wall form panels being generally co-planar;

wherein the clip has a general I-beam shaped configuration with a pair of clip arms extending from one end of the clip.

11. The connector of claim 10 further comprising:

a clip flange on a first end of the web and a pair of clip arms on a second end of the web spaced from the first end, each of the flange receiving pockets being formed between one of the clip arms, the central web and a portion of the clip flange.

12. A spreader to maintain a predetermined spacing between spaced wall forms for constructing a poured concrete wall, each of the wall forms having a flange proximate a terminal edge thereof, the spreader comprising:

a central spreader section having spaced ends with flange receiving pockets on the spaced ends of the central spreader section, each of the flange receiving pockets being adapted to be coupled to one of the flanges of the wall forms, the central spreader section being adapted to span the spacing between the spaced wall forms.

13. The spreader of claim 12 wherein the central spreader further comprises a pair of risers projecting from the ends of the central spreader section which are adapted to thereby elevate the central spreader relative to the flanges of the wall forms and provide clearance between the spreader section and the poured concrete wall.

14. The spreader of claim 12 further comprising:

a pair of spreader tabs each of which is adapted to be positioned on a front face of one of the wall forms to maintain the pre-determined spacing between the wall forms.

15. The spreader of claim 14 wherein each of the flange receiving pockets is formed between one of the spreader tabs and clip arm on an end of the spreader.

16. A method for constructing a poured concrete wall comprising the steps of:

spacing a first set of wall form panels from a second set of wall form panels with generally planar front faces of each of the wall form panels of the first and second sets being generally co-planar with the front faces of the remaining panels in that respective set, the front faces of the first set facing the front faces of the second set, each of the panels having a rearwardly projecting flange proximate a terminal edge thereof;

clipping a first flange receiving pocket of a clip onto the flange of one of the panels;

clipping a second flange receiving pocket of the clip onto the flange of an adjacent panel and thereby connecting adjacent panels in each respective set together;

pouring concrete between the first and second sets of wall form panels;

curing the concrete; and dis-assembling the first and second sets of wall form panels after the curing is completed.

17. The method of claim 16 wherein the clipping is accomplished without penetrating the flanges of the wall form panels.

18. The method of claim 16 wherein the clipping further comprises pivoting the clip relative to the wall form panel until the flange is captured in the flange receiving pocket.

19. The method of claim 16 wherein a central web of each clip is positioned between the flanges of adjacent wall for panels.

20. The method of claim 16 further comprising:

installing a spreader onto a top flange of one of the wall form panels of the first set and onto a top flange of one of the wall form panels of the second set to maintain the sets of wall form panels at a predetermined spacing from each other.

21. The method of claim 20 further comprising:

smoothing a top surface of the poured concrete wall after the pouring by passing a tool beneath a portion of the spreader installed on the first and second sets of wall form panels.

22. A method for constructing a poured concrete wall comprising the steps of:

spacing a first set of wall form panels from a second set of wall form panels with generally planar front faces of each of the wall form panels of the first and second sets being generally co-planar with the front faces of the remaining panels in that respective set, the front faces of the first set facing the front faces of the second set, each of the panels having a rearwardly projecting flange proximate a top edge thereof;

connecting the wall form panels of the first set together;

connecting the wall form panels of the second set together;

installing a spreader onto the top flange of one of the wall form panels of the first set and onto the top flange of one of the wall form panels of the second set to maintain the sets of wall form panels at a predetermined spacing from each other;

wherein the spreader comprises a pair of flange receiving pockets formed between a central web.

pouring concrete between the first and second sets of wall form panels;

curing the concrete; and dis-assembling the first and second sets of wall form panels after the curing is completed.

23. The method of claim 22 further comprising:

smoothing a top surface of the poured concrete wall after the pouring by passing a tool beneath a portion of the spreader installed on the first and second sets of wall form panels.

* * * * *

UNITED STATES PATENT AND TRADEMARK OFFICE

CERTIFICATE OF CORRECTION

PATENT NO. : 6,173,937 B1
DATED : January 16, 2001
INVENTOR(S) : Norman Cottongim It is certified that error appears in the above-identified patent and that said Letters Patent is hereby corrected as shown below:

Column 3,
Line 30, "840" should read -- 8' --.
Line 33, "the 20 opposing wall" should read -- the opposing wall --.

Column 4,
Line 57, "7 1/2" should read -- 7 ½" --.

Column 8,
Line 17, "web." should read -- web; --.

Signed and Sealed this

Twenty-sixth Day of February, 2002

*Attest:*

*Attesting Officer*

JAMES E. ROGAN
*Director of the United States Patent and Trademark Office*